US008291717B2

(12) United States Patent
Radovinsky et al.

(10) Patent No.: US 8,291,717 B2
(45) Date of Patent: Oct. 23, 2012

(54) CRYOGENIC VACUUM BREAK THERMAL COUPLER WITH CROSS-AXIAL ACTUATION

(75) Inventors: Alexey L. Radovinsky, Cambridge, MA (US); Alexander Zhukovsky, Brighton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 1173 days.

(21) Appl. No.: 12/151,149

(22) Filed: May 2, 2008

(65) Prior Publication Data

US 2009/0272127 A1 Nov. 5, 2009

(51) Int. Cl.
*F17C 13/00* (2006.01)

(52) U.S. Cl. ..... 62/50.7; 62/51.1; 62/6; 62/606

(58) Field of Classification Search ..... 62/51.1, 62/6, 50.7, 606

See application file for complete search history.

(56) References Cited

U.S. PATENT DOCUMENTS 4,438,632 A * 3/1984 Lessard et al. ..... 62/55.5
4,667,486 A 5/1987 Miller et al.
4,667,487 A 5/1987 Miller et al.
4,763,483 A 8/1988 Olsen
4,930,318 A 6/1990 Brzozowski
4,986,078 A 1/1991 Laskaris
5,216,889 A 6/1993 Herd et al.
5,222,366 A 6/1993 Herd et al.
5,235,818 A * 8/1993 Horikawa et al. ..... 62/51.1
5,379,602 A * 1/1995 Sipila et al. ..... 62/51.2
5,394,129 A 2/1995 Obasih
5,430,423 A 7/1995 Herd et al.
5,522,226 A 6/1996 Mruzek
5,682,751 A 11/1997 Langhorn et al.
5,701,742 A * 12/1997 Eckels et al. ..... 62/6
5,737,927 A 4/1998 Takahashi et al.
5,918,470 A * 7/1999 Xu et al. ..... 62/51.1

(Continued)

FOREIGN PATENT DOCUMENTS

JP 63260007 A * 10/1988
WO WO 2005/116515 A1 12/2005

(Continued)

OTHER PUBLICATIONS

Bhatia et al. , "The effects of cryocooler microphonics, EMI and temperature variations on bolometric detectors", Cryogenics 41, 2002.*

(Continued)

*Primary Examiner* — Cheryl J Tyler
*Assistant Examiner* — Valentin Tudor
(74) *Attorney, Agent, or Firm* — Steven J. Weissburg

(57) ABSTRACT

A system and method to connect a cryocooler (refrigerator) to a superconducting magnet or cooled object allows for replacement without the need to break the cryostat vacuum or the need to warm up the superconducting magnet or other cooled object. A pneumatic or other type of actuator establishes a thermo-mechanical coupling. The mechanical closing forces are directed perpendicular (cross-axially) to the cryocooler axis and are not applied to the thin wall cryocooler body or to the thin cryostat walls or to the cooled object or to its shield. It is also possible that some of the compressive force be transferred to the cryocooler body. In that case, the extensions are designed so that the forces transferred to the cryocooler thermal stages do not exceed allowable stresses in the cryocooler stage. Additionally the device provides the possibility of easy inspection and cleaning of the thermal contacting surfaces of the cryostat cold and intermediate stations from the bonded chips of compressible gasket after the cryocooler retraction.

18 Claims, 4 Drawing Sheets

U.S. PATENT DOCUMENTS

| | | | | |
|---|---|---|---|---|
| 6,092,373 | A | 7/2000 | Mundinger | |
| 6,112,530 | A | 9/2000 | Tench | |
| 6,209,443 | B1 | 4/2001 | Perez | |
| 6,438,966 | B1 | 8/2002 | Sarwinski et al. | |
| 6,438,967 | B1 | 8/2002 | Sarwinski et al. | |
| 6,556,012 | B2 * | 4/2003 | Yamashita | 324/318 |
| 7,036,323 | B2 | 5/2006 | Schnagl | |
| 7,310,954 | B2 * | 12/2007 | Miki | 62/51.1 |
| 2008/0104968 | A1 | 5/2008 | Radovinsky et al. | |

FOREIGN PATENT DOCUMENTS

| | | |
|---|---|---|
| WO | WO 2008/105845 | 9/2008 |

OTHER PUBLICATIONS

Change et al. ("Development of a thermal switch for faster cool-down by two-stage cryocooler"): discloses a gas-gap, 2000.*

Gilmore/Lankford, "Spacecraft thermal control handbook", Chapter 10 (Heat Switches), 2nd Edition, 2002.*

Leybold Vacuum, chapter "Cryopumps, Cryogenics, C12", Products and Reference Book 2003/2004.*

International Search Report and the Written Opinion of the International Searching Authority for PCT/US2007/021381, mailed on Sep. 9, 2008.

International Search Report and the Written Opinion of the International Searching Authority for PCT/US2009/02600, mailed on Jun. 26, 2009.

The Examiner is also hereby notified of the concurrent prosecution of U.S. Appl. No. 13/311,125, filed on Dec. 5, 2011 which is a divisional of U.S. Appl. No. 11/881,990, filed on Jul. 30. 2007, by the present inventors, which issued as U.S. patent No. 8069675.

* cited by examiner

CRYOGENIC VACUUM BREAK THERMAL COUPLER WITH CROSS-AXIAL ACTUATION

BACKGROUND

The progress of cryocoolers in the past 20 years has brought the technology to the state where magnet cooling in the absence of liquid cryogens is a more attractive option than with the use of liquid helium for some applications. In addition to cost and convenience, the absence of liquid helium is attractive from the point of safety, as the issues with rapid pressurization of the cryogen and possible release of helium gas to environment surrounding the device can be avoided. Cryogen-liquid-free magnets require fewer external subsystems, fewer services, and thus are also more portable.

Many applications of the cryogen-free technology have been implemented, from magnets to detectors, for applications in outer space as well as on the ground.

The present liquid-free cryocooler technology is very reliable, with present Mean-Time-Between-Failures of about 10000 hours for Gifford-McMahon cryocoolers and 20000 hours for pulse-tube cryocoolers. Although adequate for short-term applications, for long term application means of being able to replace the unit for maintenance are necessary.

Usual thermal insulation for the cooled object and for the cryocooler cold head includes vacuum isolation of the cold surfaces. Apiezon N grease is used in couplings for a better thermal contact and improved thermal conductivity at cryogenic temperatures in vacuum. In demountable (those that need to be disconnected) couplings, indium gaskets are used for the same purpose. Indium gaskets compressed in the coupling with a pressure at which indium flows plastically provide a good thermal contact in the connected couplings, with reliable demountable joints.

For some long-term applications, it is desirable to replace the head of the cryocooler without breaking the cryostat vacuum around the cold object, and sometimes even without warming up the device. The need for removing the cryocooler head, without cooled device warm-up, demands features of both the thermal management system as well as for the vacuum that surrounds the cooled magnet.

It is a purpose of an invention hereof for a mechanical and thermal coupler and a method of providing a quick thermal and mechanical connect and disconnect of a cryocooler, which does not require warm-up of the cooled device while replacing a cryocooler, which can be performed quickly without influencing the cooled object vacuum, and which can be conducted without any forces being applied to the object to be cooled, which is generally sensitive thereto. It is also important, where possible, to provide for such quick thermal and mechanical connect and disconnect of a cryocooler without applying any axial force to any of: the cooling device itself, the walls of the cooling device vacuum or the walls of the cooled object vacuum.

A device is described in a co-owned patent application in the names of the present inventors and another entitled "Cryogenic Vacuum Break Thermal Coupler." A. Radovinsky, A. Zhukovsky, V. Fishman U.S. Ser. No. 11/881,990, filed: Jul. 30, 2007; based on U.S. Ser. No. 60/850,565; filed: Oct. 10, 2006. The full disclosure of that application is hereby incorporated by reference herein. The mechanical closing forces are balanced between the intermediate temperature and low temperature cooling surfaces. For a multistage cryocooler (refrigerator) the closing compression forces are transferred through the thin cryocooler (refrigerator) body, which could cause buckling of the cryocooler body under excessive compression force. The cryocooler body between stages is made of thin metal walls to reduce the heat transfer between stages. To reinforce the cryocooler body of the device against buckling, a strong low thermal-conductivity fiberglass girder fixed between cryocooler stages may be useful. The heat transfer through the girder decreases efficiency of the cryocooler. The axial components to the cryocooler mechanical closing forces are transferred also through vacuum walls of the cryocooler vacuum envelope (part of the cryostat) requiring adequate thickness of the vacuum walls, which increases a heat load to the cold stage of the cryocooler, decreasing its thermal efficiency. It is also difficult to inspect and clean the thermal contacting surfaces of the cryostat cold and intermediate stations from any bonded chips of compressible, indium gasket after the cryocooler retraction.

Thus, it would be desirable to provide an apparatus and a means for coupling and decoupling one or more stages of a cryo-cooler (refrigerator) without applying any axial forces to the thin walls of the device, thereby avoiding a need for any sturdy reinforcement of the walls, in such a way that would place an extra thermal load on the cooler.

This is a very important quality, which increases the cryocooler thermal efficiency, because it enables using the cryocooler without any reinforcement structure and using thinner walls in the cryostat, which decrease a heat load to the cryocooler. Additionally the device enables easy inspection and cleaning of the thermal contacting surfaces of the cryostat cold and intermediate stations from any bonded chips of compressible (indium) gasket after the cryocooler retraction.

SUMMARY

A more detailed partial summary is provided below, preceding the claims. Coupler systems are described herein to provide for a quick thermal and mechanical connect and disconnect of cryocooler thermal stages with and from a cooled object. Two vacuums are used. The vacuum that is used in the cryocooler environment is different from that of the cooled object vacuum (cryostat vacuum). Mechanical means apply the required forces to maintain good contact between discrete components, to effectively transfer thermal loads in vacuum. For a two stage cooling device the actuator creates adjustable forces on interfaces between the cryocooler stages and respective thermal stations of the cooled object. Forces at the interfaces are reacted cross-axially, in the direction perpendicular to the cryocooler axis through the actuator in series with the extension of the cryocooler stage and with the strong frame surrounding the cryocooler thermal stages. The forces are not applied to the thin wall cryocooler body or to the thin cryostat walls or to the cooled object or to its shield. In a preferred embodiment, no compressive forces are applied to the cryocooler body. In another embodiment, some compressive forces may be applied to the cryocooler body. These two embodiments are explained below.

In addition, it is convenient to provide the pressures required for establishing good thermal contact across the interface of the demountable thermal joints in vacuum by means that do not transfer loads to the object to be cooled. Surfaces designed with compressible gaskets for good thermal transfer across the interface may bond, so that breaking the demountable thermal joint is difficult. Techniques and structures are disclosed to provide the forces required for separation of different elements in the interface. These techniques and structures also facilitate inspecting and cleaning the contacting surfaces for any portions of indium gasket that may be left bonded to the thermal stations after disconnection and cryocooler retraction.

DETAILED DESCRIPTION

FIGS. 1, 2, 3 and 4 show a coupler system where there are two separate vacuums for a cooled object and for the cryocooler, as well as two thermal paths for the cooled object (cold thermal path) and intermediate temperature thermal path (for the radiation shield, current leads and others).

Figure 1:
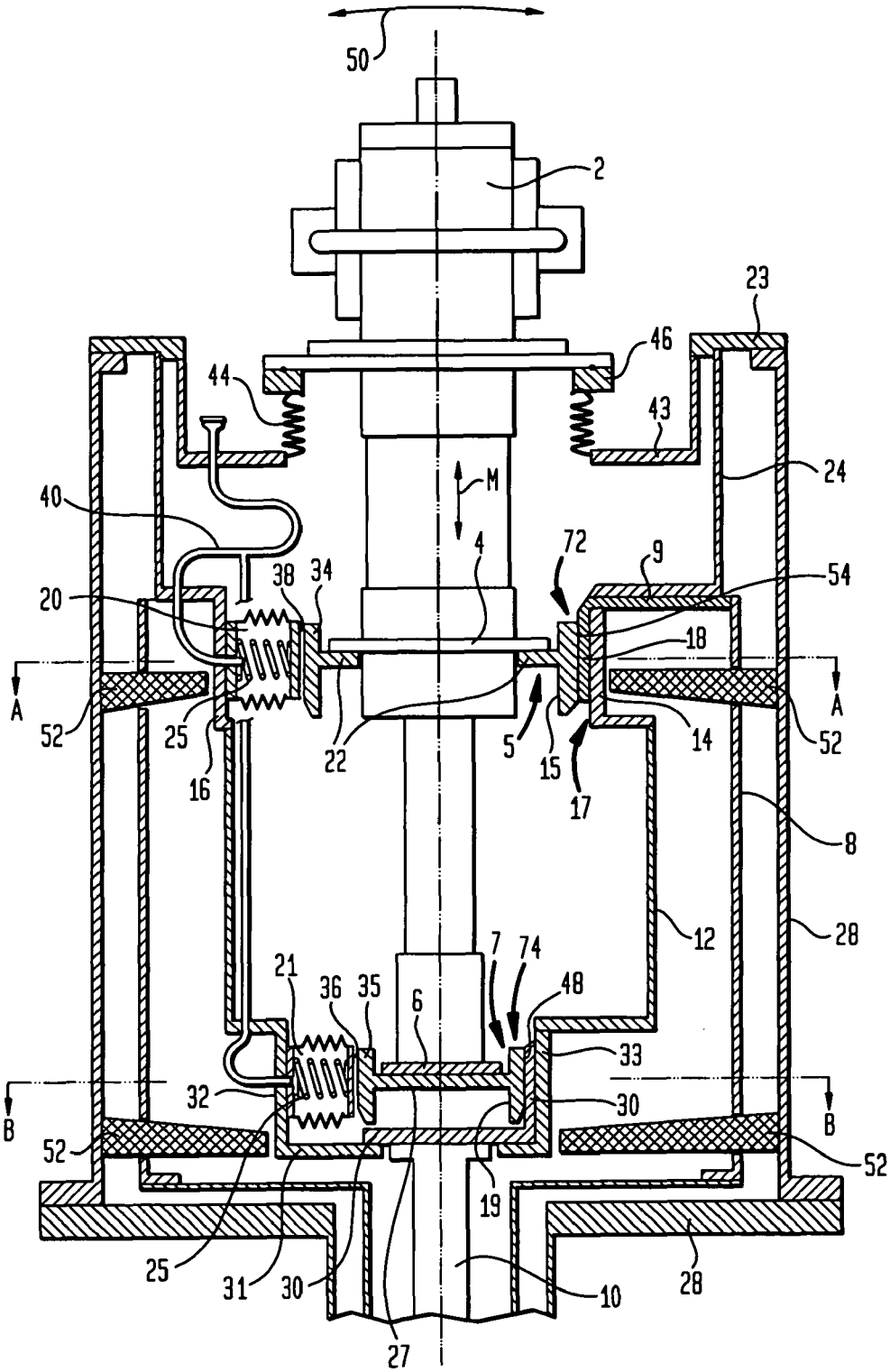
FIG. 1 shows a schematic cross-section view of part of a two-stage crycooler engaged, but with a pneumatic actuator not pressurized, and with no thermal coupling between the cryocooler and the cooled object.

FIG. 1 is a schematic cross-section through an embodiment of an apparatus invention hereof, showing the cooling device in an inserted position, but with the connections that would establish the thermal paths not engaged. By an inserted position, it is meant that the components of the cooling device are positioned adjacent the components of the cold and intermediate stations that are thermally coupled to the object to be cooled. But, although in position, the actuator is not energized and the large contact pressures necessary to establish significant thermal conduction in vacuum are not present.

In the industry, typically the warmer temperature station is referred to as the intermediate thermal station (being intermediate between cold and room temperatures). As used herein, and in the claims, either the term first, or the term intermediate may be used to identify a thermal station, that is typically not the coldest station. In the claims, typically first is used, whereas in this specification, intermediate is typically used. The word station is generally used to refer to a component permanently thermally connected with the cold object or its radiation shield. Below, the word stage is generally used to refer to a thermal component of the cooling device.

For a typical mechanism, it is also useful to define several directions for discussion purposes. An axial direction is defined by a vector M, referring to an elongated axis of the cooling device from the room temperature end to the first stage and to the cold stage. A direction from the actuator to the thermal station that is perpendicular to this axial direction and may be referred to herein as a cross-axial direction.

The object to be cooled and its surrounding cryostat are not shown in the figures, because to do so and show both to scale is awkward. Typically, the object to be cooled is significantly larger in both mass and dimensions than the cryocooler. For instance, the mass of a cryocooler could be 10-20 kg, to cool a magnet of about 1000 kg. The relative physical dimensions would be similarly sized.

FIG. 1 shows the cryocooler located in the inserted position, with both stages opposite their respective stations. But neither actuator is activated; so neither the intermediate temperature interface 72 nor the cold thermal interface 74 is effectively thermally coupled. The surfaces that make up these interfaces may be touching each other, but the forces necessary to facilitate the thermal conduction in vacuum are absent.

The cooled object vacuum envelope is comprised of cryostat vacuum wall 28 and room temperature flange 23. There is an internal boundary between the cryocooler vacuum and the cooled object vacuum established by the cryocooler envelope comprised of cold station 30, cold station frame 31, cold-to-intermediate temperature support tube 12, intermediate temperature station frame 14 and intermediate-to-room temperature support tube 24, attached to the room temperature flange 23. Then the cryocooler vacuum is separated from the outer environment by flange 43, attached to flange 23, bellows 44, vacuum flange 46, and cryocooler warm head 2. In general, the members that make up the vacuum walls, such as cold to intermediate temperature support tube 12 and intermediate to room temperature support tube 24 are thin wall cylinders.

Starting from room temperature flange 23 the cryocooler vacuum enclosure is comprised of low thermal conductive but strong, for instance, stainless steel parts consecutively welded together hermetically: thin intermediate-to-room temperature support tube 24, strong thick wall intermediate temperature station frame 14 with relatively heavy top and bottom, thin cold-to-intermediate temperature support tube 12, strong thick wall cold station frame 31 with relatively heavy top and bottom, and cold station 30. Generally, the cooling device is inserted within its vacuum enclosure along the axis M.

There are two thermal paths. Materials with a high thermal conductance, for instance annealed copper, are used to build the thermal paths. The intermediate temperature thermal path is comprised of cryocooler first stage 4, cryocooler first stage thermal extension 5, the intermediate temperature station 18, intermediate temperature thermal anchor 9, and the intermediate temperature radiation thermal shield 8, which is in good thermal contact with the intermediate temperature thermal loads. The intermediate temperature thermal loads are due to heating of the thermal shield surrounding the cooled object (mostly by radiation), the current leads, cold mass supports, and other sources of heat at temperatures between the cooled object and room temperature. To increase thermal conductance in vacuum, a pliable good thermal conducting layer can be placed between the contacting surfaces in the thermal joint. For instance, Apiezon N grease can be used in the coupling for a better thermal contact between the first stage 4 and thermal extension 5, which are not disturbed during cryocooler removal/installation. Thermal extension 5 can also be soft soldered to the surface of the first stage 4 for the best thermal contact. Other means of attachment can be used, including but not limited to, bolting, screwing, clamping, pressing, shrink-fitting, spring-loading or by using a mechanical lever-actuated contacting system connection). In general, the extension is attached to the intermediate temperature stage in such a way that the full extent of surface area of the stage that is available for attachment and heat transfer, is engaged. This will maximize heat transfer and minimize temperature drop in the joint that couples the extension to the stage. The indium gasket 54 is attached to the thermal coupling surface of the cryocooler first stage thermal extension 5. The intermediate temperature thermal path is interrupted when the pneumatic actuator 20 is pumped out and the cryocooler is mechanically decoupled by shaking the warm head of the cryocooler in direction 50, see FIG. 1, by breaking mechanical bonding and providing a vacuum in the intermediate temperature thermal path between the intermediate temperature station 18 and cryocooler first stage thermal extension 5. The gap is not open for the state of the device shown in FIG. 1. It arises at the interface 72 between the elements just mentioned. The indium gasket 54 is strongly attached to the cryocooler first stage thermal extension 5, and is removed with it during cryocooler retraction. The gap 38 for easy retraction of the cryocooler is created between the actuator moving end and plate 34 of the thermal extension 5.

Figure 2:
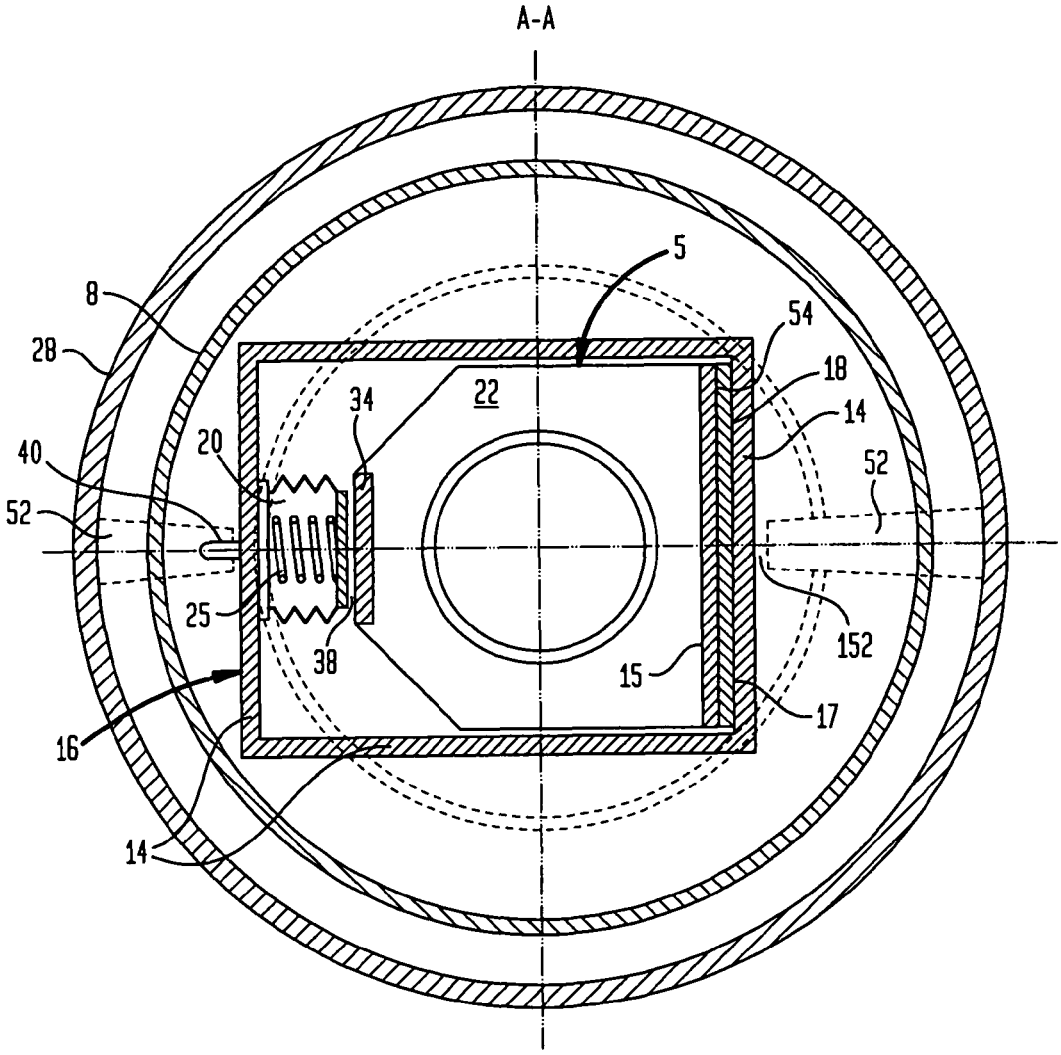
FIG. 2 shows a schematic cross-section view A-A of FIG. 1, showing the first stage of the cryocooler and thermal station of the radiation shield with the pneumatic actuator not pressurized.

The thermal extension 5, in the example shown, is made up of two elements, a copper portion, which has an end plate 15 and a ring portion 22, and plate 34, made of a steel (or other strong material). The copper ring portion 22 of the extension 5 is permanently fastened by bolts (shown only schematically) to the cryocooler first stage 4 ring surface. The thermal extension 5 may have, in plan, a rectangular, square, polygonal (as shown in FIG. 2), or other outer shape. Indium gasket 54 is bonded to the flat copper surface 15 of thermal extension 5 facing the interface surface of intermediate thermal station 18. At the opposite side of the extension 5, facing the pneumatic actuator 20, the stainless steel (or other strong material) plate 34 is fastened to the cryocooler first stage thermal extension 5. Pneumatic actuator 20 is a deformable element (bellows) that is filled with gas through the pneumatic actuator pressurization tube 40. The gas does not liquefy or solidify at the operating temperature (for instance helium). Pneumatic actuator 20 is fastened to the strong intermediate temperature station frame 14. The intermediate temperature station copper plate 18 is fastened to the side of the frame 14 opposite to the actuator and is thermally connected with radiation shield 8 by intermediate temperature thermal anchor 9.

When the cooling device is inserted, the copper plate 15 of the extension 5 slides along the intermediate thermal station 18. There can be a very small gap between them, or no gap. When actuator 20 expands, the gap 38 between the actuator and plate 34 of the extension 5 is closed. The expanding actuator applies a force to the plate 34, which pushes the extension 5 and cryocooler body first stage 4 toward the intermediate temperature station 18. When the actuator 20 is energized, the cooling device moves the distance of the very small gap, plus an even smaller movement due to compression of the indium gasket. This very small cross-axial movement is permitted by flexibility of bellows 46 in the same direction across the axis of the bellows 46. For the case shown in FIG. 4, this movement is accommodated by very flexible bellows of the vacuum envelope. The cross-axial movement of the cryocooler body is extremely small but the compression force can be as large as is needed for an excellent heat transfer through the coupling.

The indium gasket 54 is squeezed between the flat copper surface 15 of the thermal extension 5 and intermediate temperature station 18. The thermal path from the cryocooler to the radiation shield is established through the copper thermal anchor 9. Upon full engagement, equal and opposite forces are applied to the actuator 20 and to the sides of the frame 14. The thermal extension 5 is compressed between the actuator 20 and intermediate temperature station 18. To withstand compression forces against deformation, the copper extension 5 can be reinforced by a stainless steel structure (not shown). No axial forces are applied to the cryocooler, the cryostat or to the radiation shield, along the axial direction. In a preferred embodiment, no cross-axial forces are applied to the cryocooler. The frame 14 is relatively strong, as compared to the forces necessary to achieve good thermal contact. It experiences stresses due to forces in the cross-axial direction, due to the actuator pushing outward on the actuator side, and the copper extension plate 15 pushing outward on the other side under the influence of the actuator. The frame is strong enough that it does not deform under the level of force applied by the actuator, at levels sufficient to establish the required thermal conductivity through the coupling. The strong frame also makes up part of the enclosure that surrounds the cooling device, being connected directly to the support tubes 12 and 24. It prevents any of the cross-axial forces that are applied to establish the thermal conductance, from being transferred to the thin vacuum envelope walls.

The cross-axial forces are not applied to the cryocooler, because the intermediate temperature extension 5 attached to the cryocooler intermediate stage 4 in such a way that all cross-axial forces are taken up by the extension (through its steel plate 34 and copper extension 15 (reinforced by stainless steel structure if necessary), which does not deform or otherwise contact the cryocooler in such a way as to transfer cross-axial forces to the cryocooler.

There may be other embodiments where the cryocooler thermal stage is strong enough to withstand some forces in the cross-axial direction, and, in that case, the extension 5 may be constructed in such a way as to allow some cross-axial forces to be borne by the cryocooler stage. In such a case, the extension must be designed so that the forces transferred to the cryocooler (cooling device) thermal stages do not exceed allowable stresses in the cryocooler stage. (By allowable, it is meant the maximum stress that the cryocooler can withstand, without damage, further moderated by a margin of safety.)

The cold thermal path includes the cryocooler cold (second) stage 6, cryocooler cold (second) stage thermal extension 7 with indium gasket 48, cold station 30 and cold thermal anchor 10. The cold thermal anchor 10 is in good thermal contact with the cooled object (not shown). Apiezon N grease can be used in the coupling for better thermal contact between cold stage 6 and thermal extension 7 as well as between cold station 30 and cold thermal anchor 10, which are not disturbed during cryocooler removal/installation. These couplings, which are not demountable, can be also soft soldered for the best heat transfer. The extension 7 can be built in the same way as the intermediate temperature extension 5 but with one difference. The extension 7 has a central disk shape rather than a ring as 5. Extension 7 has a strong plate, for instance steel (or other strong material), as its plate 35 at the actuator facing side. This plate 35 is bonded to a central plate 27, which is in turn bonded or made as one piece of copper with a copper plate 19, to which an indium gasket is bonded. The copper plate and gasket make the thermal coupling to the cold station 30. The central plate 27 can be of copper or reinforced by a strong material, such as steel or a combination thereof. It is important that the material be thermally conductive enough to efficiently transfer thermal energy from the copper plate 19 of the extension to the cold stage 6. Yet the central plate 27 has to be also strong enough to withstand the compressive stresses that arise within it due to the action of the actuator 21. The various elements that make up the cold extension 7 can be machined from two or more parts (of a strong material and a thermally conductive material) and can be secured to each other in any suitable means. Further, the extension 7 itself can be secured to the cold stage 6 by any suitable means, including but not limited to bolting, screwing, clamping, pressing, shrink-fitting, spring-loading or a lever-actuated mechanical contacting system connection. Indium gasket 48 is bonded to the surface of the cryocooler thermal extension 7 that is in contact with the cold station 30. The cold thermal path is interrupted when pneumatic actuator 21 is pumped out and the cryocooler is mechanically decoupled by shaking the warm head of the cryocooler in direction 50, (see FIG. 1), by breaking mechanical bonding and providing vacuum in the cold temperature thermal path between the cold station 30 and cryocooler cold (second) stage thermal extension 7. The indium gasket 48 is strongly attached to the cryocooler thermal extension 7, and is removed with it during cryocooler retraction. The gap in the cold path is not open for the state of the device shown in FIG. 1. It arises at the interface 74 between the elements just mentioned. A different gap 36, for easy retraction of the cryocooler, is created between the actuator moving end and plate 35 of the thermal extension 7.

The copper intermediate temperature station 18 is connected with intermediate temperature cryostat shield by a copper thermal anchor 9 hermetically brazed to the frame 14 where the anchor penetrates from the cryocooler vacuum space to the cooled object vacuum space. The copper cold station 30 is hermetically brazed to the frame 31 around its opening for the thermal connection with cold thermal anchor 10 to separate cryocooler and cooled object vacuum spaces.

When the cooling device is inserted the extension 7 slides along the cold thermal station 30. As with the intermediate stage, there can be a very small gap between them, or no gap. When actuator 21 expands, the gap 36 between the actuator moving end and plate 35 of the extension 7 is closed. The expanding actuator applies a force to the plate 35 and the actuator extension 7, which pushes the cryocooler body cold stage 6 with extension 7 toward the cold station 30. When the actuator 21 is energized, the cooling device moves the distance of the very small gap plus an even smaller movement due to compression of the indium gasket. This cross-axial movement is permitted by flexibility of bellows 46 as explained above.

The strong frame 31 also serves an analogous function for the cold stage as does the strong frame 14 for the intermediate stage. It does not deform under the cross-axial expansive effect of the actuator 21. It also prevents any cross-axial force applied to establish the cold temperature thermal conduction from being transferred to the thin walled cooling device vacuum enclosure elements, such as the tube 12.

As has been mentioned above with respect to the intermediate temperature stage portion of the device, there may be embodiments where the cryocooler thermal stage is strong enough to withstand some forces in the cross-axial direction, and, in that case, the cold extension 7 may be constructed in such a way as to allow some cross-axial forces to be borne by the cryocooler stage. In such a case, the extension 7 must be designed so that the forces transferred to the cryocooler (cooling device) thermal stages do not exceed allowable stresses in the cryocooler stage.

FIG. 2 shows a schematic cross section of the first stage of the cryocooler, intermediate temperature thermal station, radiation shield, and cryostat vacuum wall. The first stage thermal extension 5 composed of central portion 22 and copper plate portion 15, and its steel plate 34, may have in combination, in plan, a polygonal shape. The strong frame 14 has a rectangular shape, with the pneumatic actuator 20 attached inside at one side 16 (the actuator side) and copper plate of the intermediate thermal station 18 attached to the opposite side 17 (the thermal side) of frame 14. The actuator 20 is shown in a relaxed, pumped out position with gap 38 open.

Figure 3:
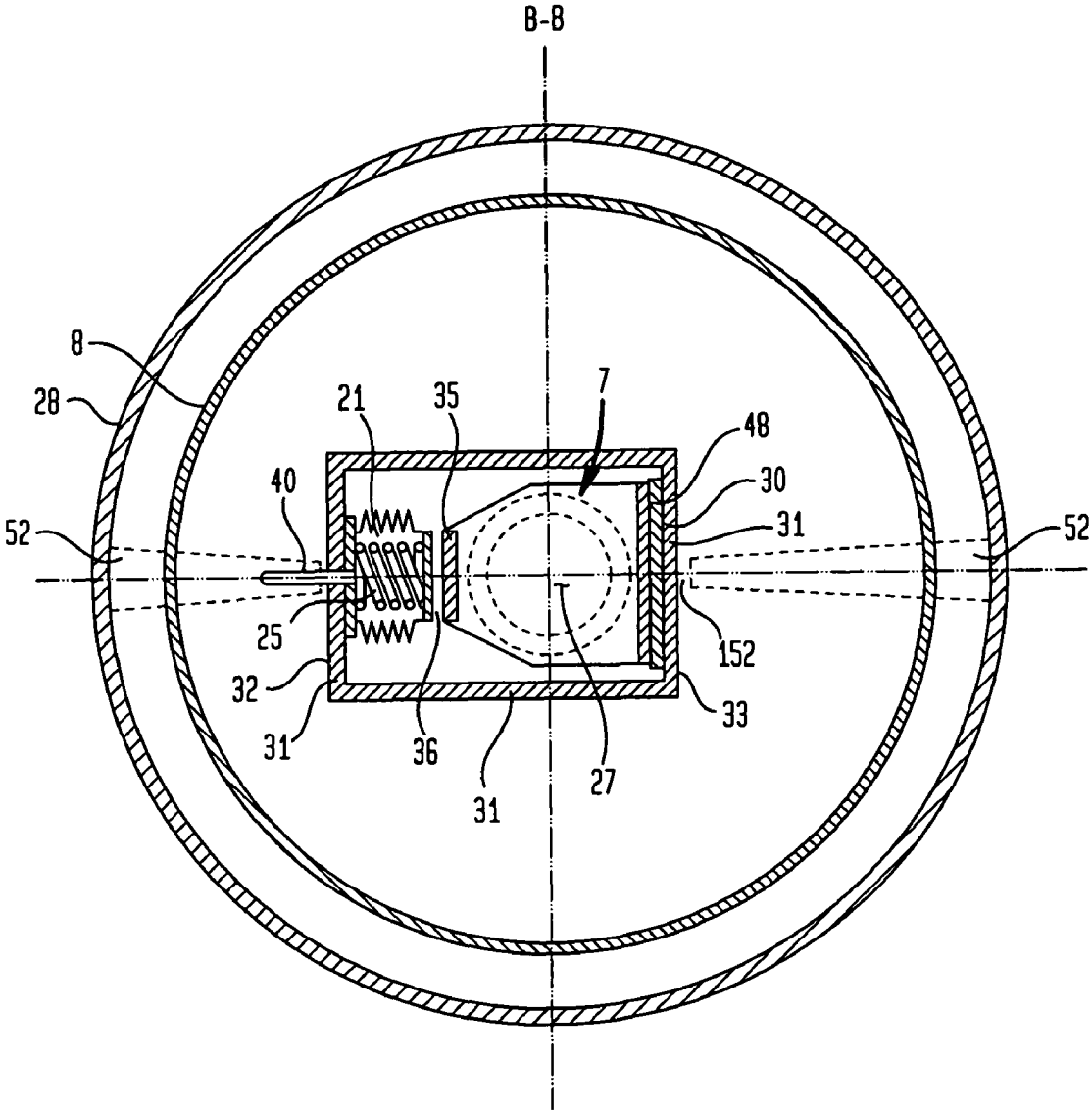
FIG. 3 shows a schematic cross-section view B-B of FIG. 1, showing the second (cold) stage of the cryocooler and thermal station of the cooled object with the pneumatic actuator not pressurized.

FIG. 3 shows a schematic cross section of the cold (second) stage of the cryocooler, cold temperature thermal station, radiation shield, and cryostat vacuum wall. The cold stage thermal extension 7 and its steel plate 35 may have, in combination, in plan a polygonal shape. The strong frame 31 has a rectangular shape with pneumatic actuator 21 attached inside at one end 32 and copper plate of cold thermal station 30 attached to the opposite side 33 of frame 31. The actuator 21 is shown in a relaxed position, with gap 36 open. The cold extension 7, in this embodiment, differs somewhat from the extension 5 of the intermediate stage, because the cold extension does not need to have a central hole to accommodate the cryocooler body, and thus, may be a plate without the central hole.

When indium gaskets 54 and 48 are squeezed between extensions of the cryocooler thermal stages and the cryostat thermal stations, they are bonded to the surfaces of the thermal stations, increasing the heat transfer through the thermal coupling in the surrounding vacuum.

For the cryocooler retraction, the indium gaskets should be unbonded from the thermal station surfaces by application of substantial unbonding forces. The retracting limiters 52 are made of low thermal conducting fiberglass, attached to the cryostat wall 28 in several (at least four) places opposite frames 14 and 31 at the sides of pneumatic actuators 20 and 21 and at the sides of thermal stations 18 and 30. The gaps 152 between the limiters and the outer surfaces of frames are chosen to provide unbonding of indium gaskets 54 and 48 from thermal station 18 and 30 when the cryocooler warm head 2 is shaken on the bellows 44 in the directions of arrows 50 (FIG. 1, and generally from left to right, as seen from above in FIGS. 2 and 3), toward the actuators and toward the indium gaskets. The gaps 152 have to be small not to deform and excessively stress the vacuum walls of the cryocooler. Pressurizing and pumping out both, actuators 20 and 21, is provided through a small diameter, relatively long low thermal conducting (for instance of stainless steel) tube 40 using the external to the cryostat systems. Actuators can be switched to the supply tube 40 in parallel (as it is shown in FIG. 1) or independently by two separate tubes (not shown) with different pressure in the tubes and actuators.

Figure 4:
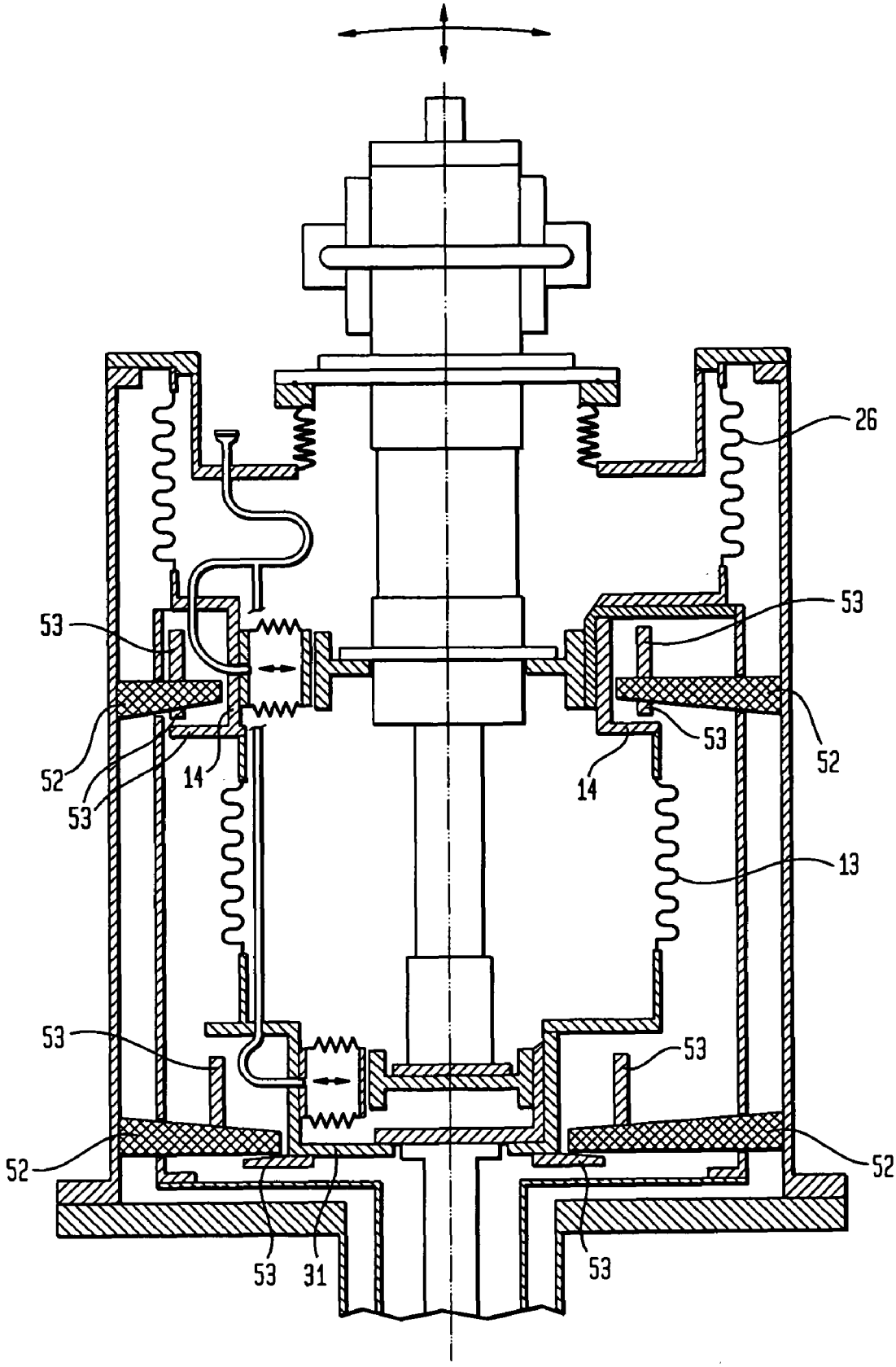
FIG. 4 shows a schematic cross-section view of a two-stage cryocooler similar to that shown in FIG. 1 with the cylindrical walls of the cryocooler vacuum envelope including bellows.

FIG. 4 shows a schematic cross section of a two-stage cryocooler with cylindrical vacuum walls of the cryocooler vacuum space 13 and 26 that include low thermal conducting thin bellows (or corrugated walls), for instance, made of stainless steel, to decrease thermal conductive heat loads to the cryocooler stages. Use of bellows improves thermal efficiency of cooling. The embodiment of an invention shown has axial limiters 53 made of low thermal conducting material, for instance fiberglass, which determine and fix the axial position of thermal stations with respect to the position of cryocooler thermal stages, opposite to each other when the cryocooler is inserted and in the operating position. Axial limiters 53 are installed with small gaps to the vacuum walls of the cryocooler. Axial limiters 53 are attached to the side limiters 52 and to the bottom of the cold station frame 31.

In a preferred embodiment, the intermediate temperature is between 25 and 90K, while the cooled object can be from 2 K all the way to 30 K. For applications with low temperature superconducting magnets the intermediate temperature is around 40-70 K, while the temperature of the cooled object (superconducting magnet) is from 3 K to 12 K.

A purpose of an invention hereof is to provide means for attaching a cryocooler with one or several stages to temperature stations of the cryostat of a cooled object in such a manner as to enable quick connect and disconnect, without applying any forces to the object to be cooled due to the thermal coupling or uncoupling with the cooling device. This operation is required for cryocooler head replacement, both for regular maintenance as well as for unscheduled maintenance, without the need to break the cooled object vacuum or to warm up the thermal radiation shield, current leads and cooled object. The cooled object can be a superconducting magnet, a detector, a motor, an electro-generator, electronics or other cooled device, while the intermediate thermal station can be thermally connected to current leads, and/or to a thermal radiation shield, and/or to mechanical supports of the cooled object to minimize a heat load of the cooled object.

An engagement sequence is described next. First the cryocooler 2 is inserted into the opening in flange 46 in such a way that the flat surfaces of the extensions 5 and 7 to the cryocooler stages 4 and 6 are located opposite thermal stations 18 and 30. During insertion the chamfers at the ends of extensions 5, 7, 34, 35 (lower ends, as shown in FIG. 1) push out the moving ends of the pneumatic actuators (bellows) 20 and 21 (if they interfere) and align the cryocooler in the position that indium gaskets 54 and 48 of extensions 5 and 7 slide along surfaces of thermal stations 18 and 30. The insertion is limited by a limiter (not shown in the drawings) when the plates 34 and 36 of extensions 5 and 7 are opposite the bellows free moving ends. The cryocooler head 2 and vacuum flange 46 are sealed to seal the cryocooler vacuum space. The space of the cryocooler vacuum is pumped out. (The pump out port is not shown in the drawings.) Engagement is then carried out by increasing the pressure of the helium gas in the pneumatic actuators 20 and 21, by feeding gas through pneumatic actuator pressurization tube 40. The pneumatic actuators 20 and 21 extend closing gaps 38 and 36, then exerting forces to stainless steel plates 34 and 35 of extensions 5 and 7 of intermediate and cold temperature stages 4 and 6. The associated copper plates of the thermal extensions 5 and 7 compress indium gaskets 54 and 48 to thermal stations 18 and 30, which are attached to the sides of strong frames 14 and 31 surrounding the cooling device. Increasing pressure in the actuators force the cryocooler extensions 5 and 7 in the cross-axial direction and squeeze indium gaskets between thermal extensions 5 and intermediate temperature station 18 and between thermal extension 7 and cold station 30. Both thermal paths to the intermediate temperature shield and to the cold object are established from copper thermal stages of the cryocooler through copper extensions, indium gaskets to copper thermal stations connected with the shield and cooled object. The compressing forces in the thermal couplings are reacted by the strong frames of each thermal station. The compression forces are transferred inside the frame sides through the pneumatic actuators, cryocooler thermal extensions plate (stainless steel), to the cryocooler thermal extension (annealed copper), which can be reinforced by some extra, strong stainless steel structure, and through the indium gasket, to the copper stations. After initial installation and after replacements when the cold object has been allowed to warm up, the cryocooler is turned on after engaging the intermediate temperature thermal path and the cold thermal path. No axial forces are applied to the cryocooler, cryostat, cold object, and its shield.

No axial or cross-axial forces are applied to the cryocooler, cryostat, cold object or its shield. The extensions are typically as strong as needed to withstand compression forces without transferring compression forces to the cooling device.

As mentioned above, there may be other embodiments where the cryocooler thermal stage is strong enough to withstand some forces in the cross-axial direction, and, in that case, the extensions 5 and 7 may be constructed in such a way as to allow some cross-axial forces to be borne by the cryocooler stage. In such a case, the extensions 5 and 7 must be designed so that the forces transferred to the cryocooler (cooling device) thermal stages do not exceed allowable stresses in the cryocooler stage.

Thus, there are no limitations to the pressure and forces developed in the demountable thermal couplings associated with axial forces compressing the cryocooler body and axial forces to walls of the cryocooler vacuum envelope. Such limitations must be accommodated in known devices with demountable thermal couplings. The cylindrical cryocooler vacuum walls between room and intermediate temperatures 24 as well as between intermediate and cold temperatures 12 can be made of thin low thermal conducting stainless steel, which decreases thermal loads to the cryocooler stages and increases thermal efficiency of the cooling process. If it is necessary further, decrease of the heat loads along the vacuum walls of the cryocooler can be reached by making the vacuum wall cylindrical parts longer, as re-entrant cylinders connected with welded rings. It is even possible to make the vacuum wall cylindrical parts of thin wall bellows or of corrugated walls, which increases the length for the heat flux and decreases the heat load to the cryocooler stages, without increasing the linear size (length) of the device. The cylindrical walls of the cryocooler vacuum envelope need only withstand the atmosphere-to-vacuum load. An embodiment that uses bellows for some or all of these walls is shown schematically with reference to FIG. 4, discussed below.

The contact pressure across the intermediate temperature 72 and cold thermal circuits 74 demountable couplings can be adjusted by varying the pressure of gas in the pneumatic actuators 20 and 21. A preferred gas in the actuators is helium. It is possible to separate gas supply to actuators 20 and 21, providing a different pressure in each actuator. It is also possible to install several parallel actuators for each frame. Such actuators can be arranged with spaced apart parallel axes. Such parallel actuators could be arranged in any suitable way such that the sum of their forces correspond to the force along the axis of the single actuator case shown. The contact pressure in the demountable couplings can be changed by changing the area of contacting surfaces.

In the case of the cold object remaining at cold temperatures, there are two options for starting up the cryocooler. One method has the cryocooler turned on and allowed to partially cool before activating the pneumatic actuators 20 and 21 connecting the cryocooler to the intermediate temperature and the cold temperature thermal paths. Alternatively, in another method the pneumatic actuators 20 and 21 are activated, establishing contact between the warm cryocooler and the colder intermediate temperature station 18 and cold station 30. After the forces in the couplings increase to the nominal forces and the intermediate temperature and cold thermal circuits are reestablished, the cryocooler is turned on. Alternatively, with a separate helium supply to actuators 20 and 21 the intermediate thermal coupling can be established first by activating the pneumatic actuator 20 of the first stage and turning on the cryocooler. When the temperature of the cold head drops to a certain level the actuator 21 is activated and the cold thermal path is established.

Pneumatic actuators 20 and 21 can be equipped with weak inner springs 25, connecting the moving (cooling device) and fixed (frame) ends of the bellows. The spring 25 provides pre-compression of the bellows when pressure inside and outside the actuator is close to equal, i.e. close to atmospheric pressure during initial assembly and retraction of the cryocooler, or vacuum during the operation. Thus, the springs keep the gaps 38 and 36 open, by pulling the free ends of bellows toward the permanently fixed ends when the actuators 20 and 21 are not pressurized. The opened gaps 38 and 36 make easier and safer insertion and retraction of the cryocooler. Pneumatic actuators 20 and 21 can be surrounded by protecting aligning cylinders with only the actuator free (moving) ends protruding out of the cylinders. The cylinders attached to the frames 14 and 31 protect actuators (bellows) against damage by the cryocooler during its insertion/retraction as well as keep the bellows aligned to their axes (for instance when the bellows have horizontal orientation).

Just removing the gas pressure from the pneumatic actuators 20 and 21 is not enough to disengage the intermediate temperature and cold stations, and substantial forces need to be applied to break the mechanical coupling involving the indium gaskets. A cryocooler disengagement and removal method is described next. If the cold object is a non-persistent superconducting magnet, the magnet is preferentially de-energized during the cryocooler replacement operation. The pneumatic actuators 20 and 21 are de-pressurized and pumped out. Then to provide forces to unbond the indium gaskets, the cryocooler warm head 2 is shaken on bellows 44 in the directions of arrows 50, generally in a cross-axial direction, toward the actuators and toward indium gaskets. Small movements of the copper extension plates with permanently bonded indium gaskets out of away from the thermal station surfaces are possible due to free movement of the actuators 20, 21 in the direction opposite to the direction the thermal station moves, due to shaking. (If the first (intermediate) stage/station couple is broken, the pivot would then be at the cold temperature station thermal extension 7 and cold stage 6 end). To a rough approximation, the cryocooler pivots about the connection between the intermediate temperature station 18 and the first stage thermal extension 5, at the indium gasket 24. These movements create huge forces separating the indium gaskets from the thermal stations. The movement of the cryocooler vacuum walls is limited by strong low thermal conducting limiters 52 (made of fiberglass, G10, for instance) installed on the cryostat outer wall 28 with small open spaces 152 to the outer walls of the frames 14 and 31. The gaps 38 and 36 are opened after indium gaskets are unbonded, due to shaking of the warm end of the cryocooler head or/and due to springs 25 inside the bellows.

In the version with cryocooler vacuum walls made of thin bellows (13 and 26 in FIG. 4) the thermal efficiency of cooling is improved due to lower heat loads to the cryocooler because of a lower thermal conductive heating. Low thermal conductive axial limiters 53 are located at a small distance from the station frames 14 and 31. Axial limiters are attached to the side limiters 52 and to the cold station frame 31. During insertion of the cryocooler into its vacuum envelope the system of axial and side limiters keep the thermal stations in the position shown, which corresponds to the operating position of the cryocooler stages opposite to the thermal stations despite flexible thin bellows of the vacuum walls. Axial limiters also keep the thermal stations at their places during the cryocooler retraction.

To retract the cryocooler, its vacuum space is filled with helium gas. The gas from an external source is introduced in the cryocooler vacuum space located near the cold station 30 (not shown in the figures), to prevent condensable gases access to the cryocooler vacuum space and from condensing on cold surfaces. The cryocooler head 2 is disconnected from the vacuum flange 46 by removing bolts connecting the cryocooler head 2 to the vacuum flange 46, while maintaining a steady flow of helium gas to prevent air from entering the cryocooler vacuum space. At this point the cryocooler can be removed. Replacement of the cryocooler has been described above, for both the cold object at near room temperature (during initial installation or during maintenance where the cold object has been allowed to be warmed up), and for when the cold object remains at low temperature. During cryocooler removal the presence of helium gas at atmospheric pressure, or slightly above, does represent a thermal load to both intermediate temperature and cold thermal circuits, but it is possible to rapidly replace the cryocooler and reestablish the vacuum before much heating of the intermediate temperature and cold thermal paths has occurred. Additionally the supplied helium gas can be pre-cooled before entering the cryocooler vacuum space to decrease heat loads to the thermal stations.

To provide, in a vacuum, good thermal contact between the cold station 30 and the cold thermal anchor 10, a thin layer of thermal conducting flexible material is introduced to the surface before assembly. A preferred material is Apiezon-N grease. The connection between cold station 30 and the cold thermal anchor 10 is established by screws, and is not disconnected during cryocooler retraction and remains cold during the maintenance operation. This connection can be of any suitable type, including but not limited to bolted, screwed, clamped, pressed, or by means of shrink-fitting or spring-loading or by using a mechanical lever-actuated contacting system connection. Apiezon-N grease also is applied in the permanent thermal joints between cryocooler thermal stages 4 and 6 and their thermal extensions 5 and 7. For a better thermal connection the permanent thermal joints can be soft soldered instead of application of Apiezon-N grease.

The demountable thermal-mechanical contacts between the cryocooler thermal extension 7 and the cold thermal station 30 is provided by a thin ductile metal that remains ductile at operating temperatures, such as indium. It is necessary to remove the indium gaskets during cryocooler removal, and thus the indium gasket 48 is adhered to the cryocooler thermal extension 7 of the cold stage 6. Similarly, the indium gasket 54 is attached to the cryocooler first stage thermal extension 5, and is removed with the cryocooler head. Another advantage of this embodiment is that after removal of the cryocooler it is easy to conduct a visual inspection and, if it is necessary, cleaning of the thermal contacting surfaces of the cryostat intermediate and cold stations from any bonded chips of compressible gasket (chips of indium). Apiezon-N grease or soft soldering are preferred in all cryogenic\thermal couplings that are not frequently disconnected, to reduce temperature drops in these joints.

An attractive feature of an invention disclosed herein is that there are no axial forces (parallel to the cryocooler axis) transferred to the cryocooler, cryostat, cold object, or to the thermal shield. The forces needed to establish good thermal conduction in both the intermediate temperature thermal path as well as in the cold thermal path are perpendicular to the cryocooler axis and are self contained inside strong frames 14, 31, surrounding the cryocooler stages. Good thermal contact is positively achieved by appropriate selection of the demountable contact areas, by application of adequate pressure in the pneumatic actuators, and by selection of parallel-switched actuators.

In a preferred embodiment, no compression forces are applied to the cryocooler. All forces are transferred through the thermal stage extension, which is typically copper, and may also be reinforced with strong steel structure. In the example shown, the fixture transduces an actuator's linear cross-axial expansion and the equal and opposite forces generated thereby, to a compression force applied to each of the interfaces 72, 74, at extensions of the cooling device intermediate and cold temperature stages. Alternative actuation and fixture designs are possible. What is required is that engagement of the thermal conduction path between the object to be cooled and the cooling device take place without any unbalanced forces applied externally to the object to be cooled or to the cooling device. The forces in the thermal coupling are self-contained in the two circuits, each consisting of an extension of a stage of the cooling device an actuator, and a strong frame. It is also possible that some of the compressive force be transferred to the cryocooler body. In that case, the extensions 5 and 7 have to be designed so that the forces transferred to the cryocooler (cooling device) thermal stages do not exceed allowable stresses in the cryocooler stage.

The actuators need not be linear, or pneumatic. Either or both may be rotary, linkages, compressive, etc. They can be electro-mechanical, pneumatic, hydraulic, etc. In general, as the actuators are powered, the cooling device is brought to a coupled position with the object to be cooled. With a linear actuator, it is powered to expand. Other actuators may be powered to rotate elements into a coupled position. A pneumatic actuator, powered by a gas such as helium, does provide the control advantages described above, in a cryogenic context.

The foregoing has described a cryocooler having two stages: a first stage, referred to herein as an intermediate temperature stage, and a second stage, referred to herein sometimes as a cold (lowest temperature) stage. Different cooling devices are used for different applications. The cooling device could be a different kind of cryocooler, such as a pulse tube, Gifford-McMahon, or Sterling type, with one or two stages (one or two temperature levels), cryostats with cryogenic liquid, cryogenic refrigerators (with one, two, or three levels of cooling temperatures) a cryogenic Dewar, a chiller, etc. A two-stage cryocooler typically has a united cooling system with two stages (to be connected with the cooled object). It is also possible for there to be more than two stages. For instance, cryogenic refrigerators), could have three stages available for cooling (for instance 78 K, 20 K, 2.0 K). Usually the coldest temperature is used to cool the cooled object and the higher temperatures are used to cool thermal shields (one or two) around the cooled object, current leads, cold mass supports and so on. A multi-level temperature cooling scheme decreases power required for cooling.

Rather than two stages, there may be only one stage. With a single stage cryocooler, the coupling between the cryocooler, and the object to be cooled would be similar, if not identical to that shown for the cold stage of the two-stage device. Thus, there is no need for a separate figure.

While particular embodiments have been shown and described, it will be understood by those skilled in the art that various changes and modifications may be made without departing from the disclosure in its broader aspects. It is intended that all matter contained in the above description and shown in the accompanying drawings shall be interpreted as illustrative and not in a limiting sense.

The cooled object could be a superconducting magnet, cryogenic magnet (made of non-superconducting wires, with a very low electrical resistance at cryogenic temperatures), infrared detectors (for instance for a night vision and temperature measurements), space instruments (bolometers) for measurements of earth temperature, different electronic devices, cryo-medical and cryo-surgical instrumentation and equipment, etc. Important features, common with all of these devices, are: separate vacuum thermal insulation for both source of cooling and cooled object; and the ability to disconnect the source of cooling and replace it without breaking the insulating vacuum of the cooled object (and not to warm it up).

Partial Summary

One important embodiment of an invention disclosed herein is a coupler for thermally coupling a cooling device to an object to be cooled, the cooling device having at least one cooling stage, which extends along an axis. The coupler comprises: a cold station configured to couple with a cold stage extension of a cooling device at a cold station interface and configured to connect with an object to be cooled; and a cold stage extension coupled to the cooling device cold stage. Mechanically rigidly connected to the cold station, is a cold station frame, having an actuator side and a thermal side, which is arranged to face the cold station interface. All is arranged such that the cold stage of the cooling device fits between the frame actuator side and the thermal side. An actuator is arranged to apply substantially equal and opposite cross-axial forces to the cold stage extension and the actuator side of the cold station frame, thereby forcing the cold stage extension from an uncoupled configuration into a coupled configuration with the cold stage extension contacting the cold station at the cold station interface, without any force being applied to the object to be cooled. There is also a cooling device vacuum enclosure, shaped and sized to house a cooling device vacuum around the cooling device, comprising the cold station; and a cooled object vacuum enclosure, shaped and sized to house an object to be cooled, comprising the cold station, arranged to house a cooled object vacuum that is hydraulically independent from the cooling device vacuum.

For an important embodiment, the extension is coupled to the cold stage in a manner that transfers no cross-axial force to the cold stage of the cooling device.

It may also be that the extension is coupled to the cold stage in a manner that transfers no greater than allowable cross-axial stress to the cold stage of the cooling device.

It may further be that the cold stage extension contacts the cold station without any unbalanced force being applied to the cooling device.

Another important embodiment may be arranged such that the cold stage extension contacts the cold station without any axial force being applied to the cooling device.

It is also an aspect of a useful embodiment of an invention hereof that the cold stage extension contacts the cold station without any force being applied to the cooling device vacuum enclosure other than balanced forces in a cross-axial direction in the thermal stations.

Yet another related embodiment is that in which the cold stage extension contacts the cold station without any axial force being applied to the cooling device vacuum enclosure.

Still another desirable embodiment has the feature wherein the cold stage extension contacts the cold station without any force being applied to the cooled object vacuum enclosure other than balanced forces in the cross-axial direction in the thermal stations.

It is typically useful that the cold station be configured to connect fixedly with an object to be cooled.

It is also beneficial that there be, thermally coupled to the cold stage, a gasket, such as an indium gasket.

For a very useful embodiment, the actuator comprises a pneumatic actuator.

With a particularly advantageous embodiment the pneumatic actuator may be one that uses as a source of actuation a gas that does not liquefy at the minimal operating temperature of the cooling device cold stage, such as helium.

The actuator may also comprise a plurality of pneumatic actuators, arranged to operate in parallel, in which case they are arranged so that the sum of the forces that they apply is in a cross-axial direction.

A very beneficial embodiment of an invention hereof uses for the actuator, a pneumatic bellows. The actuator may optionally comprise an internal rest position spring, that establishes a rest position for the actuator when pressures inside and outside the actuator are equal.

More generally speaking, important embodiments of inventions hereof include an actuator comprising a linearly extendible member having two ends. A fixed end is coupled to the actuator side of the cold frame and the other end is arranged to contact and push, upon energization, the extension of the cold stage of the cooling device, toward the cold station interface.

The cold stage extension may terminate in two plates. A first plate may comprise a relatively high thermal conductivity material and the second plate may comprise a relatively low thermal conductivity material, as compared to the first plate. The relatively low thermal conductivity material may comprise a relatively stronger material than the high thermal conductivity material.

Yet another embodiment may present the cold frame comprising two oppositely facing faces, that are rigidly coupled to each other.

The cooling device may be a cryocooler. The object to be cooled may be a magnet, including a superconducting magnet.

For a highly useful embodiment, the apparatus coupled functionally to the object to be cooled may comprise a magnetic resonance imaging apparatus.

In yet another embodiment, an invention hereof includes both the coupler and a cooling device, which may be a cryocooler, or a device selected from the group consisting of a refrigerator, a cryogenic Dewar and a chiller.

A frequently present feature is that the cooling device vacuum enclosure and the cooled object enclosure have walls that extend axially, generally parallel to each other, the actuator being arranged so that any forces that arise within the cold station frame are cross-axial.

It is helpful in some embodiments of inventions hereof that the cooling device vacuum enclosure comprise extensible walls, such as those including bellows.

For a related and also very important embodiment, the cooling device further has an intermediate temperature stage. In such a case, the coupler further comprises: an intermediate temperature station configured to couple with an intermediate temperature stage extension of a cooling device at an intermediate temperature station interface and configured to thermally couple with an object to be cooled; and an intermediate stage extension, coupled to the cooling device intermediate stage. Mechanically rigidly connected to the intermediate temperature station, there is an intermediate temperature station frame, having an actuator side and a thermal station side, which is arranged to face the intermediate temperature station interface. All is arranged such that the intermediate temperature stage of the cooling device fits between the intermediate temperature station frame actuator side and the thermal side. A second actuator is arranged to apply substantially equal and opposite cross-axial forces to the intermediate temperature stage extension and the actuator side of the intermediate temperature station frame, thereby forcing the intermediate temperature stage extension from an uncoupled configuration into a coupled configuration, with the intermediate temperature stage extension contacting the intermediate temperature station at the intermediate temperature station interface, without any force being applied to the object to be cooled.

As with the single stage embodiments, it would typically be that the intermediate temperature stage extension is coupled to the intermediate stage in a manner that transfers no cross-axial force to the intermediate stage of the cooling device.

Yet one more apparatus embodiment of an invention hereof is configured further wherein the intermediate temperature stage extension contacts the intermediate temperature station at the intermediate temperature station interface, in a manner that transfers no greater than allowable cross-axial stress to the intermediate stage of the cooling device.

Other aspects of inventions disclosed herein are methods. One is a method to thermally couple a cooling device having at least one cooling stage that extends along an axis, to an object to be cooled. The method comprises the steps of: providing a thermal coupler of a special sort. The coupler comprises: a cold station configured to couple with a cold stage extension of a cooling device at a cold station interface and configured to connect with an object to be cooled; and a cold stage extension coupled to the cooling device cold stage. Mechanically rigidly connected to the cold station is a cold station frame, having an actuator side and a thermal side, which is arranged to face the cold station interface. All is arranged such that the cold stage of the cooling device fits between the frame actuator side and the thermal side. An actuator is arranged to apply substantially equal and opposite cross-axial forces to the cold stage extension and the actuator side of the cold station frame, thereby forcing the cold stage extension from an uncoupled configuration into a coupled configuration, with the cold stage extension contacting the cold station at the cold station interface, without any force being applied to the object to be cooled. A cooling device vacuum enclosure is shaped and sized to house a cooling device vacuum around the cooling device, and comprises the cold station. A cooled object vacuum enclosure, is shaped and sized to house an object to be cooled, comprising the cold station, arranged to house a cooled object vacuum that is hydraulically independent from the cooling device vacuum. After providing the apparatus, the method further comprises the steps of introducing the cooling device into the cooling device vacuum enclosure, and positioning the cold stage extension of the cooling device in an uncoupled position, cross-axially between the actuator side of the cold station frame and the thermal side of the cold station frame. The actuator is energized, so that it engages the cold stage extension, thereby forcing the cold stage extension from an uncoupled position, toward a coupled position, contacting the cold station at the interface without any force being applied to the object to be cooled.

For a related, very typical embodiment, the actuator is arranged to apply substantially equal forces, without any cross-axial force being applied to the cooling device. The step of energizing the actuator comprises energizing the actuator, so that it engages the cold stage extension, without any force being applied to the cooling device.

For a similar, also typical, important embodiment, the actuator is arranged to apply substantially equal forces, without any cross-axial stress being applied to the cooling device greater than allowable cross-axial stress. The step of energizing the actuator comprises energizing the actuator, so that it engages the cold stage extension, without any cross-axial stress greater than allowable cross-axial stress being applied to the cooling device.

With a useful preferred method embodiment, the actuator comprises a pneumatic actuator, and the step of energizing the actuator comprises increasing the pressure of a gas provided to the actuator.

With another useful aspect of a method embodiment, the step of providing a thermal coupler further comprises providing an indium gasket, bonded to the cold stage extension.

Related to this embodiment, is a method further comprising the steps of de-energizing the actuator, so that it applies no force to the cold stage extension, pulling the cold stage extension away from the cold station, thereby opening a gap between the cold stage extension and the cold station and removing the cooling device from the cooling device vacuum enclosure. Next, can be conducted the steps of visually inspecting the cold station at the location at which the indium gasket was forced by the cold stage extension to contact the cold station, to identify and then mechanically remove any chips of the gasket that may have become bonded to the cold station.

For still another important aspect of a method embodiment of an invention hereof, the actuator comprises a pneumatic actuator, and the step of energizing the actuator comprises increasing the pressure of helium gas provided to the actuator.

A related embodiment of a method invention hereof further comprises the step of establishing a vacuum within the cooling device vacuum enclosure.

An important method embodiment of an invention hereof further comprises the step of activating the cooling device. This may take place before the step of energizing the actuator, or after.

In a typical embodiment of a method hereof, the step of providing a coupler comprises providing a coupler having: an intermediate temperature station configured to couple with an intermediate temperature stage extension of the cooling device at an intermediate temperature station interface and configured to connect with the object to be cooled; and an intermediate stage extension coupled to the cooling device intermediate temperature stage. Mechanically rigidly connected to the intermediate temperature station is an intermediate temperature station frame, having an actuator side and a thermal side, which is arranged to face the intermediate temperature station interface. All is further arranged such that the intermediate temperature stage of the cooling device fits between the actuator support frame side and the thermal side. An intermediate stage actuator is arranged to apply substantially equal and opposite cross-axial forces to the intermediate temperature stage extension and the actuator side of the intermediate temperature station frame, thereby forcing the intermediate temperature stage extension from an uncoupled configuration into a coupled configuration, with the intermediate temperature stage extension contacting the intermediate temperature station at the intermediate temperature station interface, without any force being applied to the object to be cooled. The method itself, in addition to providing these additional elements, further comprises the steps of: positioning the intermediate stage extension of the cooling device in an uncoupled position, cross-axially between the actuator side of the intermediate station frame and the thermal side of the intermediate station frame; and energizing the intermediate actuator, so that it engages the intermediate stage extension, thereby forcing the intermediate stage extension from an uncoupled position, toward a coupled position, contacting the intermediate station at the interface without any force being applied to the object to be cooled.

Many techniques and aspects of the inventions have been described herein. The person skilled in the art will understand that many of these techniques can be used with other disclosed techniques, even if they have not been specifically described in use together. For instance, the cooling device may be one, two or more stages. The cross-axial actuator may be used on one or more of the stages, but need not be used on all. The extensions for multiple stages may be constructed nearly identically, as described herein, or significantly differently from each other, as long as they fulfill the requirements set forth herein of providing adequate thermal conductance, and adequate physical strength to withstand any cross-axial stresses. At each stage, single or multiple actuators can be used, and they may be all of the same sort, or each of a different sort.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

What is claimed is:

1. A coupler for thermally coupling a cooling device to an object to be cooled, the cooling device having at least one cooling stage, which extends along an axis, the coupler comprising:

a. a cold station configured to couple with a cold stage extension of a cooling device at a cold station interface and configured to connect with an object to be cooled;

b. the cold stage extension coupled to the cooling device cold stage, the cold stage extension terminating in two plates;

c. mechanically rigidly connected to the cold station, a cold station frame, having an actuator side and a thermal side which is arranged to face the cold station interface, all arranged such that the cold stage of the cooling device fits between the frame actuator side and the thermal side;

d. an actuator, comprising a linearly extendible member having two ends, a fixed end, coupled to the actuator side of the cold station frame and the other end arranged to contact and push, upon energization, the extension of the cold stage of the cooling device, toward the cold station interface, the actuator arranged to apply substantially equal and opposite cross-axial forces to the cold stage extension and the actuator side of the cold station frame, thereby forcing the cold stage extension from an uncoupled configuration into a coupled configuration with the cold stage extension contacting the cold station at the cold station interface, without any force being applied to the object to be cooled;

e. a cooling device vacuum enclosure, shaped and sized to house a cooling device vacuum around the cooling device, comprising the cold station; and f. a cooled object vacuum enclosure, shaped and sized to house an object to be cooled, comprising the cold station, arranged to house a cooled object vacuum that is hydraulically independent from the cooling device vacuum.

2. The coupler of claim 1, a first plate comprising a relatively high thermal conductivity material and the second plate comprising a relatively low thermal conductivity material, as compared to the first plate.

3. The coupler of claim 2, the relatively low thermal conductivity material comprising a relatively stronger material than the high thermal conductivity material.

4. A coupler for thermally coupling a cooling device to an object to be cooled, the cooling device having at least one cooling stage, which extends along an axis, the coupler comprising:

a. a cold station configured to couple with a cold stage extension of a cooling device at a cold station interface and configured to connect with an object to be cooled;

b. the cold stage extension coupled to the cooling device cold stage;

c. mechanically rigidly connected to the cold station, a cold station frame, having an actuator side and a thermal side which is arranged to face the cold station interface, all arranged such that the cold stage of the cooling device fits between the frame actuator side and the thermal side;

d. an actuator arranged to apply substantially equal and opposite cross-axial forces to the cold stage extension and the actuator side of the cold station frame, thereby forcing the cold stage extension from an uncoupled configuration into a coupled configuration with the cold stage extension contacting the cold station at the cold station interface, without any force being applied to the object to be cooled;

e. a cooling device vacuum enclosure, shaped and sized to house a cooling device vacuum around the cooling device, comprising the cold station; and f. a cooled object vacuum enclosure, shaped and sized to house an object to be cooled, comprising the cold station, arranged to house a cooled object vacuum that is hydraulically independent from the cooling device vacuum;

g. an intermediate temperature station configured to couple with an intermediate temperature stage extension of a cooling device at an intermediate temperature station interface and configured to thermally couple with an object to be cooled;

h. an intermediate stage extension, coupled to the cooling device intermediate stage;

i. mechanically rigidly connected to the intermediate temperature station, an intermediate temperature station frame, having an actuator side and a thermal station side, which is arranged to face the intermediate temperature station interface, all arranged such that the intermediate temperature stage of the cooling device fits between the intermediate temperature station frame actuator side and the thermal side; and j. a second actuator, arranged to apply substantially equal and opposite cross-axial forces to the intermediate temperature stage extension and the actuator side of the intermediate temperature station frame, thereby forcing the intermediate temperature stage extension from an uncoupled configuration into a coupled configuration, with the intermediate temperature stage extension contacting the intermediate temperature station at the intermediate temperature station interface, without any force being applied to the object to be cooled.

5. The coupler of claim 4, the intermediate temperature stage extension being coupled to the intermediate stage in a manner that transfers no cross-axial force to the intermediate stage of the cooling device.

6. The coupler of claim 4, further wherein the intermediate temperature stage extension contacts the intermediate temperature station at the intermediate temperature station interface, in a manner that transfers no greater than negligibly small cross-axial stress to the intermediate stage of the cooling device.

7. A method to thermally couple a cooling device having at least one cooling stage that extends along an axis, to an object to be cooled, the method comprising the steps of:

a. providing a thermal coupler comprising:

i. a cold station configured to couple with a cold stage extension of a cooling device at a cold station interface and configured to connect with an object to be cooled;

ii. a cold stage extension coupled to the cooling device cold stage;

iii. mechanically rigidly connected to the cold station, a cold station frame, having an actuator side and a thermal side which is arranged to face the cold station interface, all arranged such that the cold stage of the cooling device fits between the frame actuator side and the thermal side;

iv. an actuator arranged to apply substantially equal and opposite cross-axial forces to the cold stage extension and the actuator side of the cold station frame, thereby forcing the cold stage extension from an uncoupled configuration into a coupled configuration, with the cold stage extension contacting the cold station at the cold station interface, without any force being applied to the object to be cooled;

v. a cooling device vacuum enclosure shaped and sized to house a cooling device vacuum around the cooling device, comprising the cold station; and vi. a cooled object vacuum enclosure, shaped and sized to house an object to be cooled, comprising the cold station, arranged to house a cooled object vacuum that is hydraulically independent from the cooling device vacuum;

b. introducing the cooling device into the cooling device vacuum enclosure, and positioning the cold stage extension of the cooling device in an uncoupled position, cross-axially between the actuator side of the cold station frame and the thermal side of the cold station frame;

c. energizing the actuator, so that the actuator engages the cold stage extension, thereby forcing the cold stage extension from an uncoupled position, toward a coupled position, contacting the cold station at the interface without any force being applied to the object to be cooled.

8. The method of claim 7, the actuator being arranged to apply substantially equal forces, without any cross-axial force being applied to the cooling device, the step of energizing the actuator comprising energizing the actuator, so that it engages the cold stage extension, without any force being applied to the cooling device.

9. The method of claim 7, the actuator being arranged to apply substantially equal forces, without any cross-axial stress being applied to the cooling device greater than negligibly small cross-axial stress, the step of energizing the actuator comprising energizing the actuator, so that the actuator engages the cold stage extension, without any cross-axial stress greater than negligibly small cross-axial stress being applied to the cooling device.

10. The method to couple of claim 7, the actuator comprising a pneumatic actuator, the step of energizing the actuator comprising increasing the pressure of a gas provided to the actuator.

11. The method of claim 7, the step of providing a thermal coupler further comprising, providing an indium gasket, bonded to the cold stage extension.

12. The method of claim 11, further comprising the steps of:

a. de-energizing the actuator, so that the actuator applies no force to the cold stage extension;

b. pulling the cold stage extension away from the cold station, thereby opening a gap between the cold stage extension and the cold station;

c. removing the cooling device from the cooling device vacuum enclosure; and d. visually inspecting the cold station at the location at which the indium gasket was forced by the cold stage extension to contact the cold station, to identify and then mechanically remove any chips of the gasket that may have become bonded to the cold station.

13. The method of claim 7, the actuator comprising a pneumatic actuator, the step of energizing the actuator comprising increasing the pressure of helium gas provided to the actuator.

14. The method to couple of claim 7, further comprising the step of establishing a vacuum within the cooling device vacuum enclosure.

15. The method to couple of claim 7, further comprising the step of activating the cooling device.

16. The method to couple of claim 15, the step of activating the cooling device taking place before the step of energizing the actuator.

17. The method to couple of claim 15, the step of activating the cooling device taking place after the step of energizing the actuator.

18. The method of claim 7, wherein:

a. the step of providing a coupler comprises providing a coupler further having:

i. an intermediate temperature station configured to couple with an intermediate temperature stage extension of the cooling device at an intermediate temperature station interface and configured to connect with the object to be cooled;

ii. an intermediate stage extension coupled to the cooling device intermediate temperature stage;

iii. mechanically rigidly connected to the intermediate temperature station, an intermediate temperature station frame, having an actuator side and a thermal side, which is arranged to face the intermediate temperature station interface, all arranged such that the intermediate temperature stage of the cooling device fits between the actuator support frame side and the thermal side; and iv. an intermediate stage actuator arranged to apply substantially equal and opposite cross-axial forces to the intermediate temperature stage extension and the actuator side of the intermediate temperature station frame, thereby forcing the intermediate temperature stage extension from an uncoupled configuration into a coupled configuration, with the intermediate temperature stage extension contacting the intermediate temperature station at the intermediate temperature station interface, without any force being applied to the object to be cooled;

b. the method further comprising the steps of:

i. positioning the intermediate stage extension of the cooling device in an uncoupled position, cross-axially between the actuator side of the intermediate station frame and the thermal side of the intermediate station frame; and ii. energizing the intermediate actuator, so that the actuator engages the intermediate stage extension, thereby forcing the intermediate stage extension from an uncoupled position, toward a coupled position, contacting the intermediate station at the interface without any force being applied to the object to be cooled.

* * * * *